United States Patent [19]

Skinner et al.

[11] Patent Number: 4,809,938

[45] Date of Patent: Mar. 7, 1989

[54] BABY BOTTLE HOLDER

[76] Inventors: Sara J. Skinner; Gregory S. Skinner, both of P.O. Box 8106, Incline Village, Nev: 89450

[21] Appl. No.: 122,063

[22] Filed: Nov. 18, 1987

[51] Int. Cl.[4] ..... A45C 9/00

[52] U.S. Cl. ..... 248/102

[58] Field of Search ..... 248/102, 105, 106

[56] References Cited

U.S. PATENT DOCUMENTS

| | | | |
|---|---|---|---|
| 2,354,568 | 7/1944 | Allen | 248/105 |
| 2,450,927 | 10/1948 | Allen | 248/105 |
| 2,451,718 | 10/1948 | Corrao | 248/105 |
| 2,475,923 | 7/1949 | Suich | 248/105 |
| 2,485,461 | 10/1949 | Siegel | 248/102 |
| 2,510,953 | 6/1950 | Brose | 248/102 |
| 2,522,647 | 9/1950 | Suich | 248/105 |
| 2,631,288 | 3/1953 | Daust | 248/102 X |
| 3,081,895 | 3/1963 | Siegel | 248/102 X |
| 4,227,270 | 10/1980 | Rivera | 248/102 X |
| 4,564,957 | 1/1986 | Scharf | 248/102 X |

FOREIGN PATENT DOCUMENTS

| | | | |
|---|---|---|---|
| 497172 | 12/1938 | United Kingdom | 248/105 |
| 583408 | 12/1946 | United Kingdom | 248/102 |

*Primary Examiner*—J. Franklin Foss
*Assistant Examiner*—Robert A. Olson

[57] ABSTRACT

An envelope having a strap upon its upper side in which a baby bottle is retained for nursing, wherein said envelope simulates the characteristics of an animated figure, and wherein the front side of said envelope simulates the facial characteristics of the figure, and wherein the strap parts constitutes the nose of the figure.

3 Claims, 2 Drawing Sheets

BABY BOTTLE HOLDER

This invention relates to improvements in the supporting of baby bottles for use by infants and, more particularly, to an improved baby bottle holder associated with a pillow for support.

BACKGROUND OF THE INVENTION

Many attempts have been made to support a baby bottle on an infant in a manner such that a person attending to the infant need not continue to hold the bottle while the bottle nipple is in the mouth of the infant. For the most, these attempts have been unsatisfactory for one or more reasons. Thus, a need has continued to exist for an improved baby bottle holder which adequately suports a baby bottle in a position such that an infant can have access to the nipple of the bottle yet the bottle remains in place at all times during the feeding period. The present invention satisfies this need.

SUMMARY OF THE INVENTION

The present invention is directed to a baby bottle holder including an envelope for containing a pillow to provide a mound-like body which is placed on the chest of the infant. The body has a strap for wrapping around a baby bottle so that the body supports the baby bottle in a substantially tilted condition so that a child can have access to the nipple of the bottle when the body is on the chest of the infant. The body containing the pillow is extremely light weight in construction so that the infant does not experience any heavy weight on its chest. The envelope has closure means sold under the trademark VELCRO for quick release attachment of the flap to the envelope body. Moreover, the strap for holding the baby bottle has hook and loop type attachment tabs sold under the trademark VELCRO which can be adapted to releasably attach different sized bottles through the body by virtue of the adjustability of the VELCRO material itself.

The envelope can be made of colorful material or fabric, such as a design showing a particular animal facial characteristics with the nose of the design being the strap for holding the bottle in place.

IN THE DRAWINGS

Figure 4:
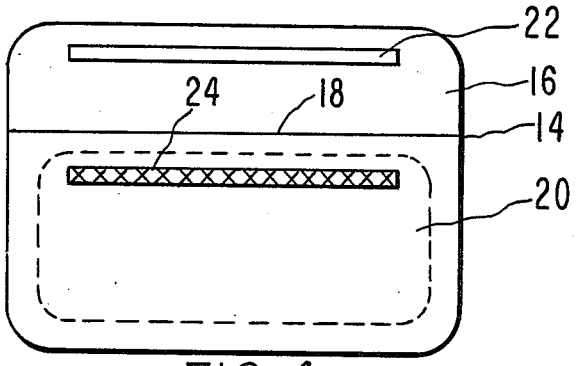
FIG. 4 is a rear elevational view of the envelope for containing the pillow and includes a holder 12 of light weight material.
Figure 5:
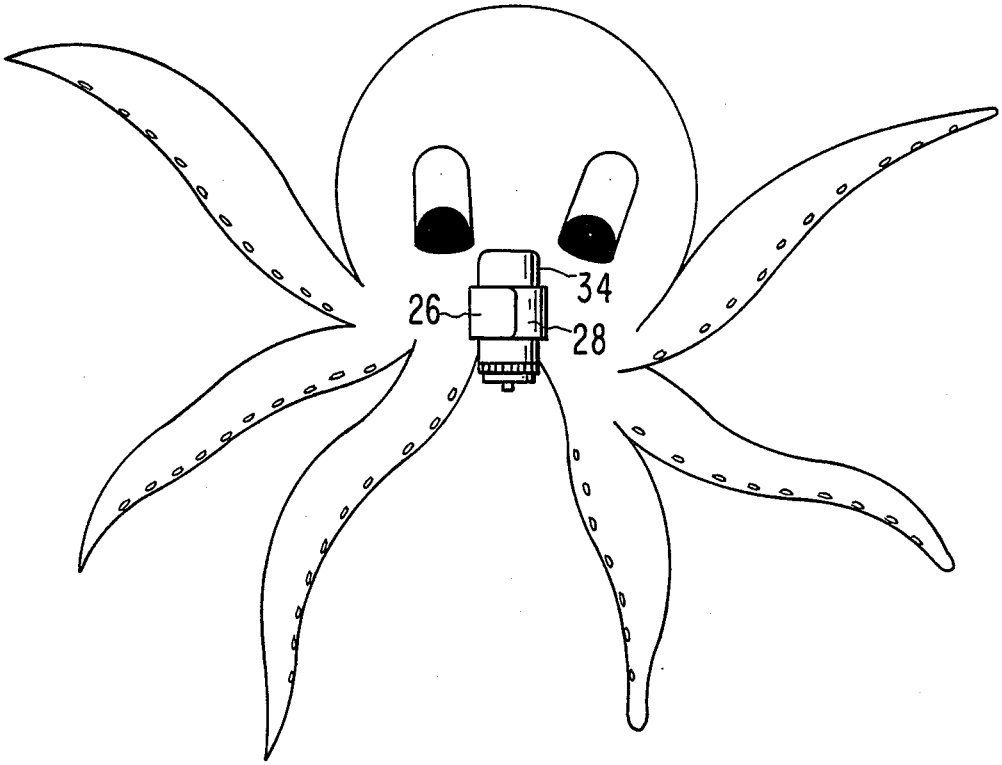

FIG. 5 is a top view of the baby bottle holder of the present invention showing an envelope design depicting a particular animal's physical characteristics with the nose of the design being the strap for holding the bottle in place. The reference numeral 10 represents the baby bottle holder of the present invention, wherein body 12 comprises an envelope 14 having a flap 16 (FIG. 4) which points toward and away from body 14 and has an opening 18 to permit a pillow 20 to be inserted into the envelope. VELCRO straps 22 and 24 are used for releasably holding the flap 16 in a closed condition.

Figure 2:
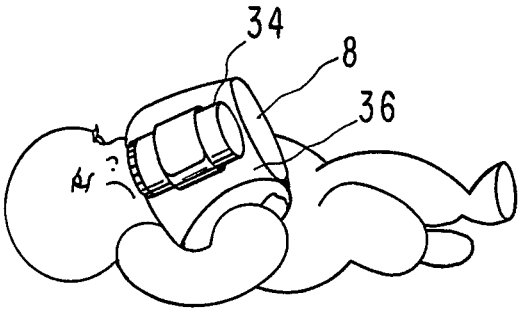
FIG. 2 is a side elevational view of the holder showing the way in which a baby is fed from the bottle of the holder.

The body 14 has a pair of strap parts 26 and 28 provided with VELCRO strips 30 and 32 for holding a baby bottle 34 on the back side 36 of body 14. The location of strap tabs 26 and 28 are such that the bottle 34 is inclined as shown in FIG. 2 so that the baby can suck on the nipple of the bottle and draw out the contents in a normal fashion.

Figure 1:
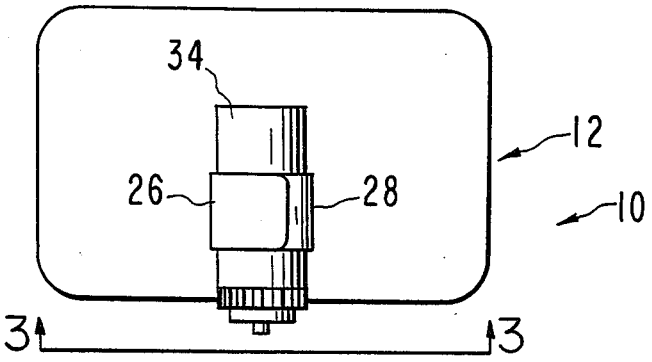
FIG. 1 is a top plan view of the baby bottle holder of the present invention.
Figure 3:
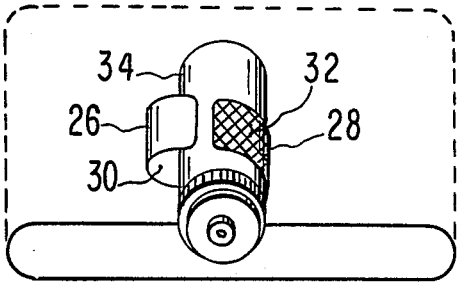
FIG. 3 is a front elevational view taken along line 3—3 of FIG. 1.

In use, the pillow is placed within envelope 14 and flap 16 is closed. Then the bottle is filled with the contents to be fed to the infant and the nipple is placed on the bottle. The bottle is then placed on body 14 and straps 26 and 28 are caused to encircle the bottle as shown in FIGS. 1–3. Then the envelope or body 14 is placed on the chest of the child as shown in FIG. 2 and the baby is allowed to drink from the bottle. The envelope 12 can be made of colorful fabric or imitation fur material depicting a particular animal's facial characteristics. The nose of the animal is incorporated into the bottle holder by way of the Velcro straps 26 and 28.

Pillow can be made of nylon fabric and can be of dimensions such as 10 inches in length, six inches wide and two inches high. The pillow can be filled with styrofoam bean bag stuffing material so that it can weigh as small as 1.25 ounces.

The envelope 14 can be made of colorful fabrics or imitation animal fabric (fur) to correspond with the physical characteristics of the animal figure. The envelope is rectangular shaped and big enough to accommodate pillow 20.

We claim:

1. A baby bottle holder comprising:

an envelope having an opening and a closure flap;

means insertable into the envelope for providing stuffing therefor; and a pair of strap parts secured at their end to the envelope and adapted to partially encircle a baby bottle, quick release fastening means on the ends of the parts to releaseably attaching the same to hold the bottle on the envelope, wherein said envelope simulates the characteristics of an animated figure, and wherein the front side of said envelope simulates the facial characteristics of the figure, and wherein the strap parts constitutes the nose of the figure.

2. A baby bottle holder as set forth in claim 1, wherein the straps are located such that the baby bottle is at an angle when the envelope with the stuffing material therein is resting on the chest of an infant.

3. A method as set forth in claim 1, wherein the stuffing material means includes a pillow.

* * * * *